US008356437B1

(12) United States Patent
Holmes et al.

(10) Patent No.: US 8,356,437 B1
(45) Date of Patent: Jan. 22, 2013

(54) FIRING PIN POSITION INDICATOR FOR GUN

(75) Inventors: Edward W. Holmes, Valley Falls, NY (US); Wayland P. Barber, Mechanicville, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 326 days.

(21) Appl. No.: 12/875,327

(22) Filed: Sep. 3, 2010

(51) Int. Cl.
*F41A 9/53* (2006.01)

(52) U.S. Cl. ..... 42/1.01; 42/70.08; 89/27.12; 89/27.14

(58) Field of Classification Search ..... 42/1.01, 42/70.08; 89/27.11, 27.12, 27.13, 27.14
See application file for complete search history.

(56) References Cited

U.S. PATENT DOCUMENTS

| | | | | |
|---|---|---|---|---|
| 2,517,333 | A * | 8/1950 | Motley | 89/1.803 |
| 5,410,942 | A * | 5/1995 | Begneu | 89/27.14 |
| 5,924,232 | A * | 7/1999 | Rhoden et al. | 42/70.11 |
| 7,779,740 | B1 * | 8/2010 | Holmes et al. | 89/27.12 |

* cited by examiner

*Primary Examiner* — Gabriel Klein
(74) *Attorney, Agent, or Firm* — Michael C. Sachs

(57) ABSTRACT

A firing pin position indicator may be mounted to the breech end of a weapon. The indicator may include a solenoid with a plunger and a firing pin adapter that is selectively engageable with the plunger. The firing pin adapter may be fixed to the firing pin of the weapon. The solenoid plunger may be coupled to a quick-release lock. The quick-release lock may be selectively engageable with the firing pin adapter. The quick-release lock may include a housing and a spring-loaded piston that is translatable in the housing. The quick-release lock housing may be coupled to the solenoid plunger with a pin. A sensor may sense the position of the solenoid plunger and may provide a control signal to the weapon.

19 Claims, 6 Drawing Sheets

FIRING PIN POSITION INDICATOR FOR GUN

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to guns, such as, for example, mortars and artillery.

When using a 120 mm breech-loaded mortar weapon, for example, the rounds (ammunition) may sometime misfire. It is difficult to determine if the round has been struck by the firing pin, or if the firing pin has been damaged. The mortar weapon may use a revolving firing pin. A suitable revolving firing pin is disclosed in U.S. patent application Ser. No. 12/008,782 filed on Jan. 10, 2008, which is expressly incorporated by reference herein.

The revolving firing pin may be aligned to strike the round only when the mortar system breech block is closed and locked. A prior firing pin solenoid was not attached to the firing pin. Thus, the firing pin position could not be seen from outside of the breech mechanism. And, there was no indication of what did or did not occur in the mortar system when a round misfired. Because of the danger of a slow burn, the breech block could not be immediately opened after a misfire. After waiting a period of time, for example, ten minutes, the breech block could be opened to inspect the firing pin and determine the cause of the misfire.

A need exists for an apparatus to provide an indication of the cause of a misfire in a breech-loaded weapon.

SUMMARY OF THE INVENTION

It is an object of the invention to provide an apparatus for providing an indication of the cause of a misfire in a breech-loaded weapon.

One aspect of the invention is a firing pin position indicator. The firing pin indicator may be mounted to the breech end of a weapon. The firing pin indicator may include a solenoid having a plunger, and a firing pin adapter. The firing pin adapter may be selectively engageable with the plunger. The firing pin adapter may be selectively translatable with the plunger. The firing pin adapter may be selectively rotatable with the plunger.

The plunger may be coupled to a quick-release lock. The quick-release lock may be selectively engageable with the firing pin adapter. The quick-release lock may include a spring-loaded piston that may be translatable in a quick-release lock housing. The quick-release lock housing may be coupled to the plunger with a pin.

The quick-release lock may include a drive ball. In a first position of the drive ball, the quick-release lock may be engaged with the firing pin adapter. In a second position of the drive ball, the quick-release lock may not be engaged with the firing pin adapter.

The plunger may include a plunger extension and the quick-release lock housing may be coupled to the plunger extension with the pin. The plunger extension may include a through-bore. The quick-release lock may be at least partially disposed in the through-bore. The firing pin position indicator may further include a quick-release lock actuator pin at least partially disposed in the through-bore and translatable in the through-bore. The quick-release lock actuator pin may be engageable with a head of the spring-loaded piston of the quick-release lock.

The firing pin position indicator may include a sensor for sensing a position of the plunger. The sensor may be, for example, a proximity sensor.

Another aspect of the invention is a firing pin position indicator mounted to the breech end of a weapon. The weapon may include a firing pin. The firing pin position indicator may include a solenoid with a plunger, and a firing pin adapter connected to the firing pin of the weapon. The firing pin adaptor may be selectively engageable with the plunger.

A further aspect of the invention is a weapon with a breech end. The weapon may include a firing pin position indicator mounted to the breech end. The firing pin position indicator may include a solenoid with a plunger, and a firing pin adapter that is selectively engageable with the plunger. The firing pin may be connected to the firing pin adapter.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A firing pin indicator may be mounted to the rear of the carrier of a breech-loaded weapon. The firing pin indicator may be attached to the firing pin of the weapon. The firing pin indicator may indicate the position of the firing pin. The firing pin may be out of view because the firing pin is within the carrier housing. The firing pin indicator may be in view of the operator of the weapon. The firing pin indicator may include a flexible strip. The flexible strip may be sensed by, for example, a proximity sensor. The flexible strip may be made of metal. The weapon may shut down if the strip is not sensed by a sensor or seen by the operator of the weapon.

Figure 1:
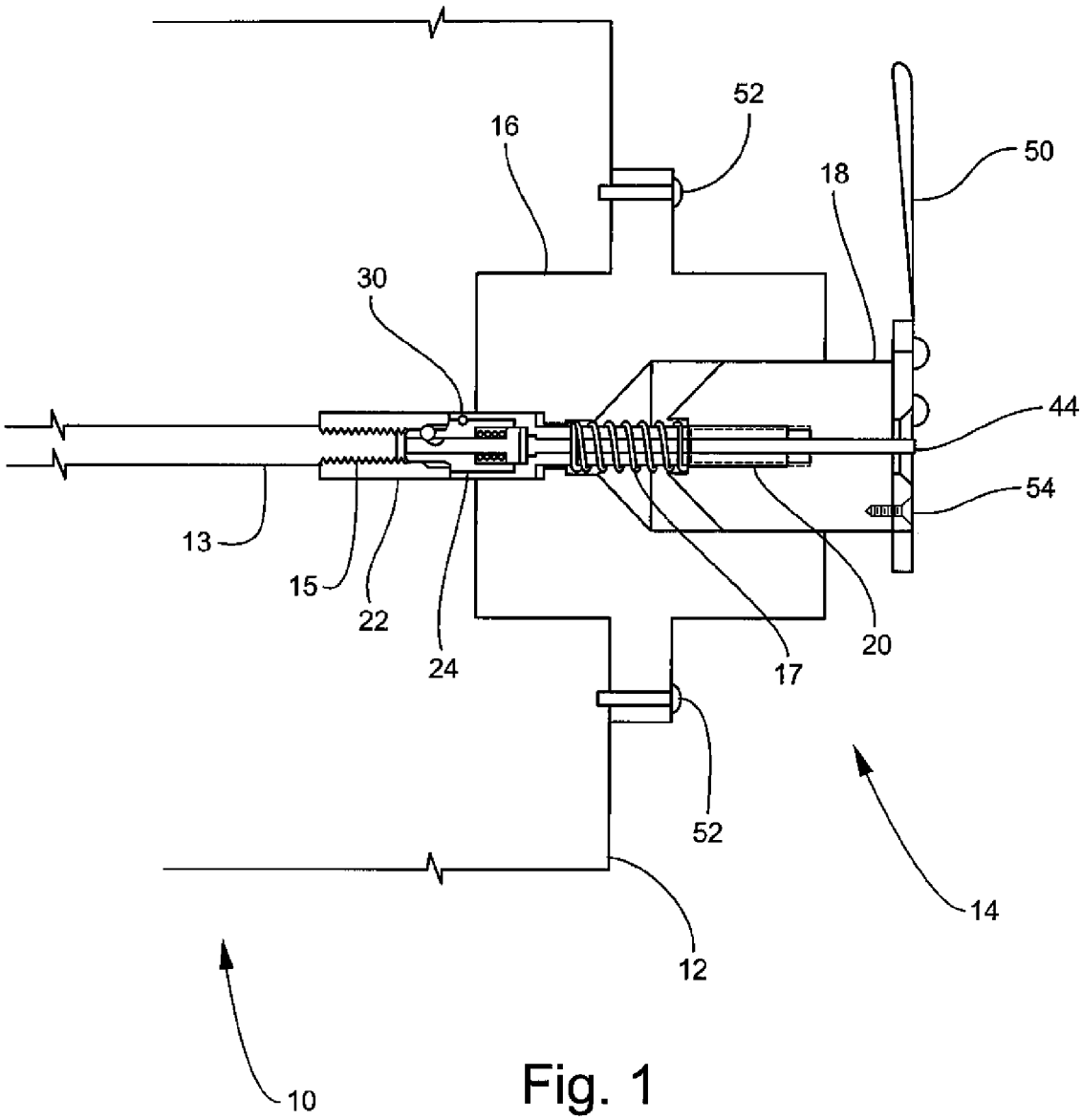
FIG. 1 is cutaway, partial side view of a weapon with an embodiment of a firing pin position indicator.

FIG. 1 is cutaway, partial side view of a weapon 10 with an embodiment of a firing pin position indicator 14. Weapon 10 may have a breech end 12 and a firing pin 13. Firing pin position indicator 14 may be mounted to breech end 12 of weapon 10. Indicator 14 may include a solenoid 16. Solenoid 16 may include a plunger 18 and a spring 17. A firing pin adapter 22 may be selectively engageable with plunger 18. Firing pin adapter 22 may be selectively translatable with plunger 18. Firing pin adapter 22 may be selectively rotatable with plunger 18. Firing pin 13 may include a threaded portion 15 for engaging firing pin adapter 22.

Figure 2:
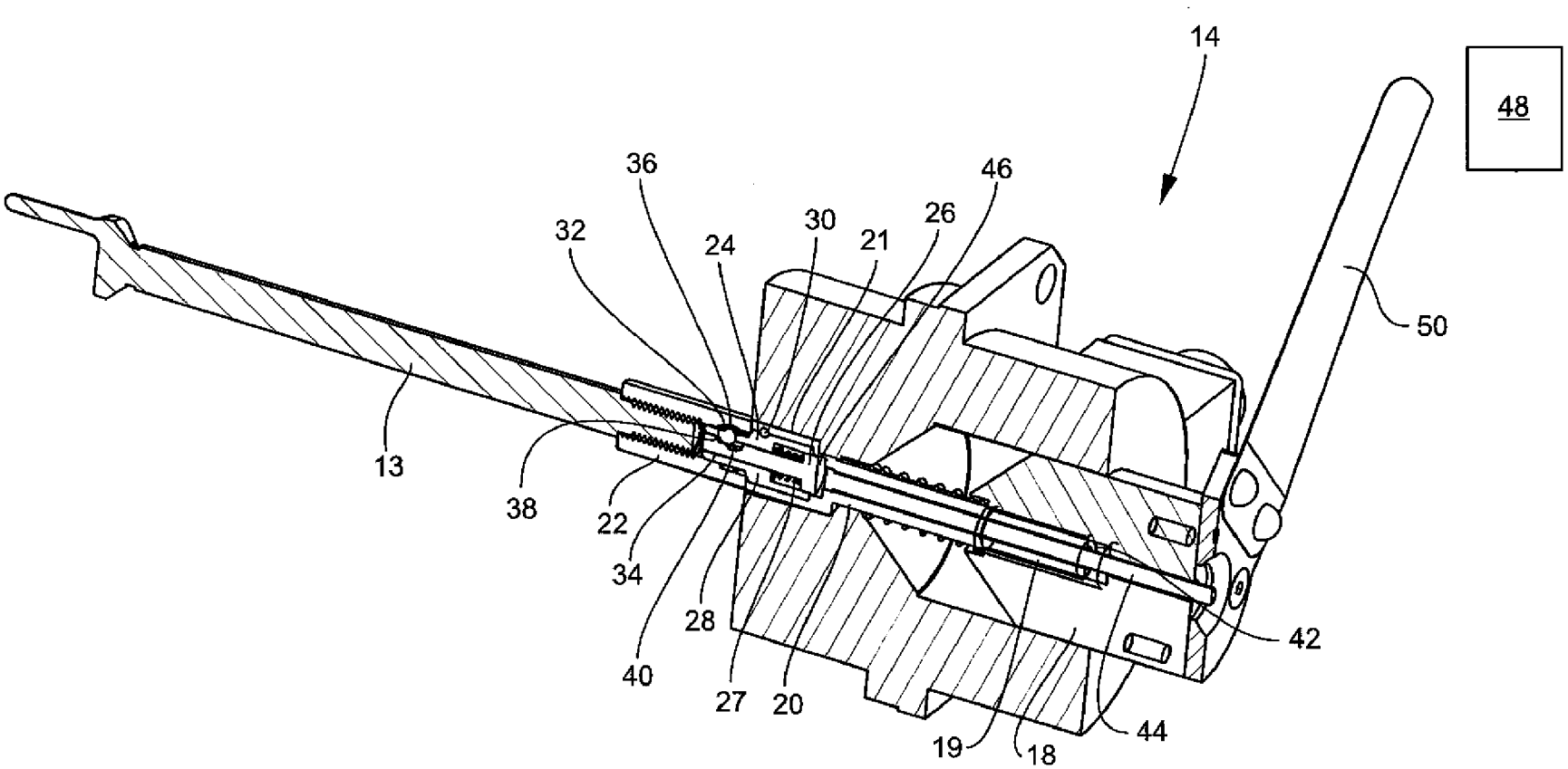
FIG. 2 is a perspective view of FIG. 1, without the breech of the weapon, and with the firing pin in the ready to fire position.

FIG. 2 is a perspective view of FIG. 1, without breech 12 of weapon 10, and with firing pin 13 in a ready to fire position. Plunger 18 may include a plunger extension 20. One end 19 of plunger extension 20 may be coupled to plunger 18 using, for example, threads. Another end 21 of plunger extension 20 may be coupled to a quick-release lock 24 using, for example, a cylindrical pin 30. Quick-release lock 24 may be selectively engageable with firing pin adapter 22. Quick-release lock 24 may allow plunger 18 to follow movement of firing pin 13.

Firing pin adapter 22 may include the function of the firing pin guide disclosed in U.S. patent application Ser. No. 12/008,782, referenced above.

Quick-release lock 24 may include a housing 28 and a spring-loaded piston 26. Spring 27 may load piston 26. Spring-loaded piston 26 may be translatable in quick-release lock housing 28. Quick-release lock housing 28 may be coupled to plunger extension 20 with pin 30. Quick-release lock 24 may include a drive ball 32. In a first position of drive ball 32 (shown in FIG. 2), quick-release lock 24 may be engaged with firing pin adapter 22. In a second position of drive ball 32, quick-release lock 24 may not be engaged with firing pin adapter 22.

Spring-loaded piston 26 may include a notched portion 34. Firing pin adapter 22 may include an opposing notched portion 36. Notched portion 34 of spring-loaded piston 26 may include a shallow notch 38 and a deep notch 40. In the first position of drive ball 32 shown in FIG. 2, drive ball 32 may be disposed in shallow notch 38 of spring-loaded piston 26 and in opposing notched portion 36 of firing pin adapter 22. In the second position of drive ball 32, drive ball 32 may be disposed in deep notch 40 of spring-loaded piston 26 and in opposing notched portion 36 of firing pin adapter 22.

Plunger extension 20 may include a through-bore 42. Quick-release lock 24 may be at least partially disposed in through-bore 42. A quick-release lock actuator pin 44 may be at least partially disposed in through-bore 42. Quick-release lock actuator pin 44 may be translatable in through-bore 42. Quick-release lock actuator pin 44 may be engageable with a head 46 of spring-loaded piston 26 of quick-release lock 24. Translation of quick-release lock actuator pin 44 may cause quick-release lock 24 to disengage from and engage with firing pin adapter 22.

One or more sensors 48 may sense the position of plunger 18. Sensors 48 may be connected to a control system (not shown) of weapon 10. Plunger 18 may include a projecting portion 50. Sensor or sensors 48 may sense a position of projecting portion 50. Sensor 48 may be, for example, a proximity sensor. Projecting portion 50 may be, for example, a flexible metal strip.

Figure 3B:
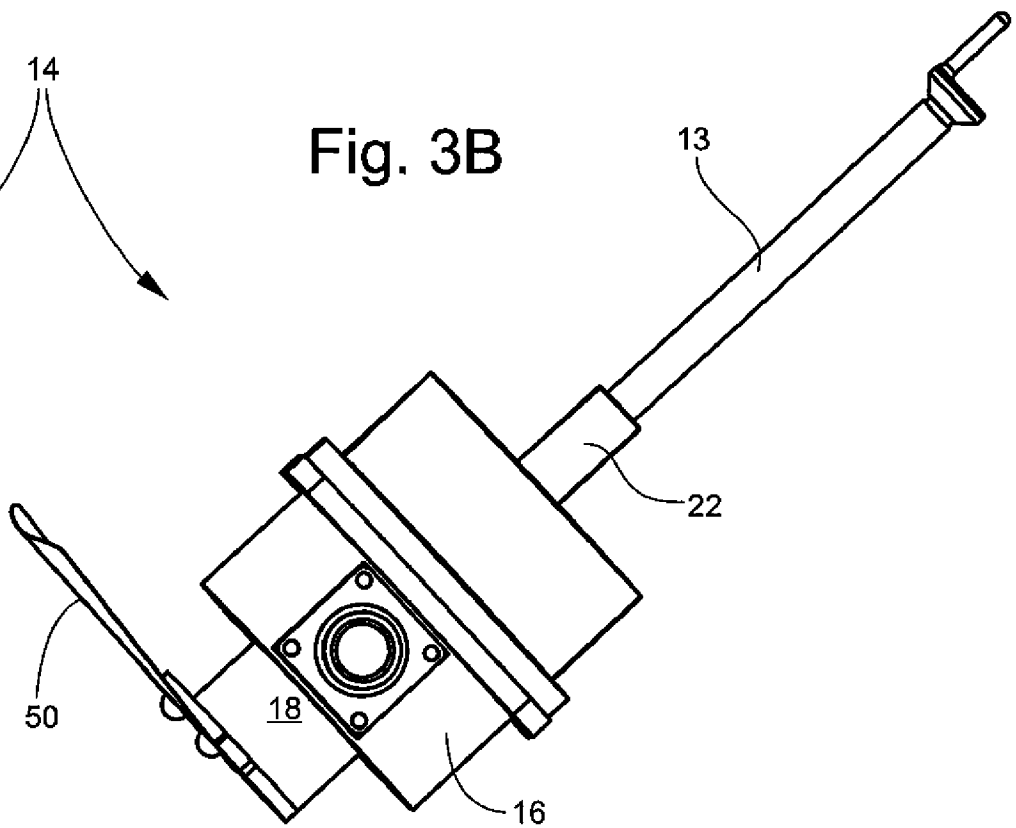
FIG. 3A is a rear perspective view and FIG. 3B is a right side view of the firing pin position indicator of FIG. 2, with the firing pin in the ready to fire position.
Figure 3A:
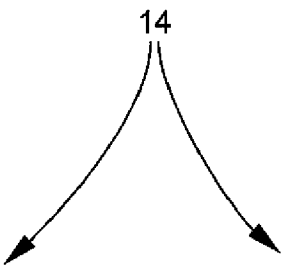
Figure 3A:
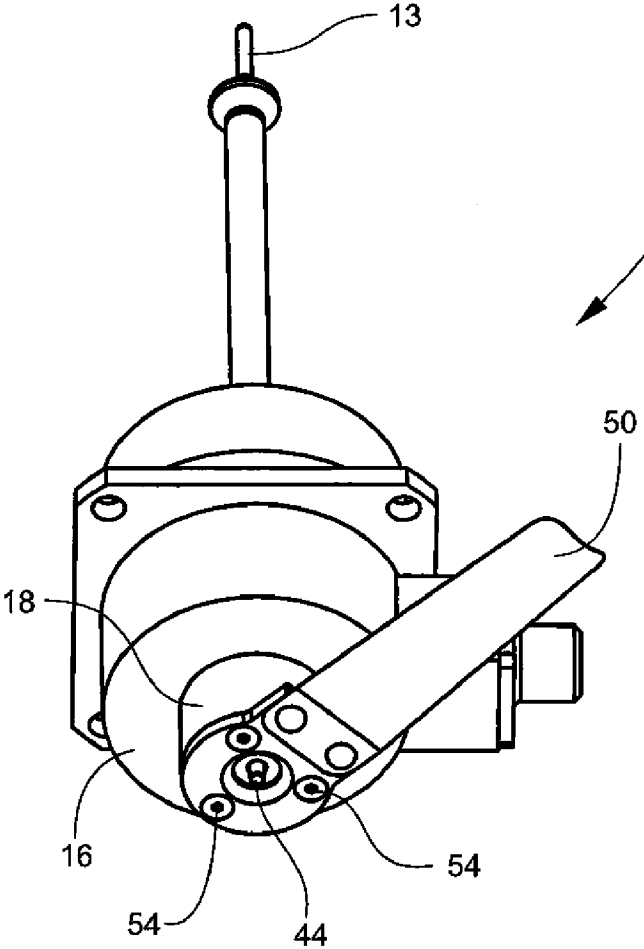

FIG. 3A is a rear perspective view and FIG. 3B is a right side view of firing pin position indicator 14 of FIG. 2, with firing pin 13 in the ready to fire position. Firing pin 13 is aligned with the primer on the round (not shown). Solenoid 16 is not activated, that is, plunger 18 has not been moved inward into the solenoid housing. The breech block is closed and locked. Projecting portion 50, therefore, is in a "rear" position and rotated to the right, as seen in FIG. 3A. In this position, projection portion 50 may be detected by a sensor 48 (FIG. 2).

Figures 4A, 4B:
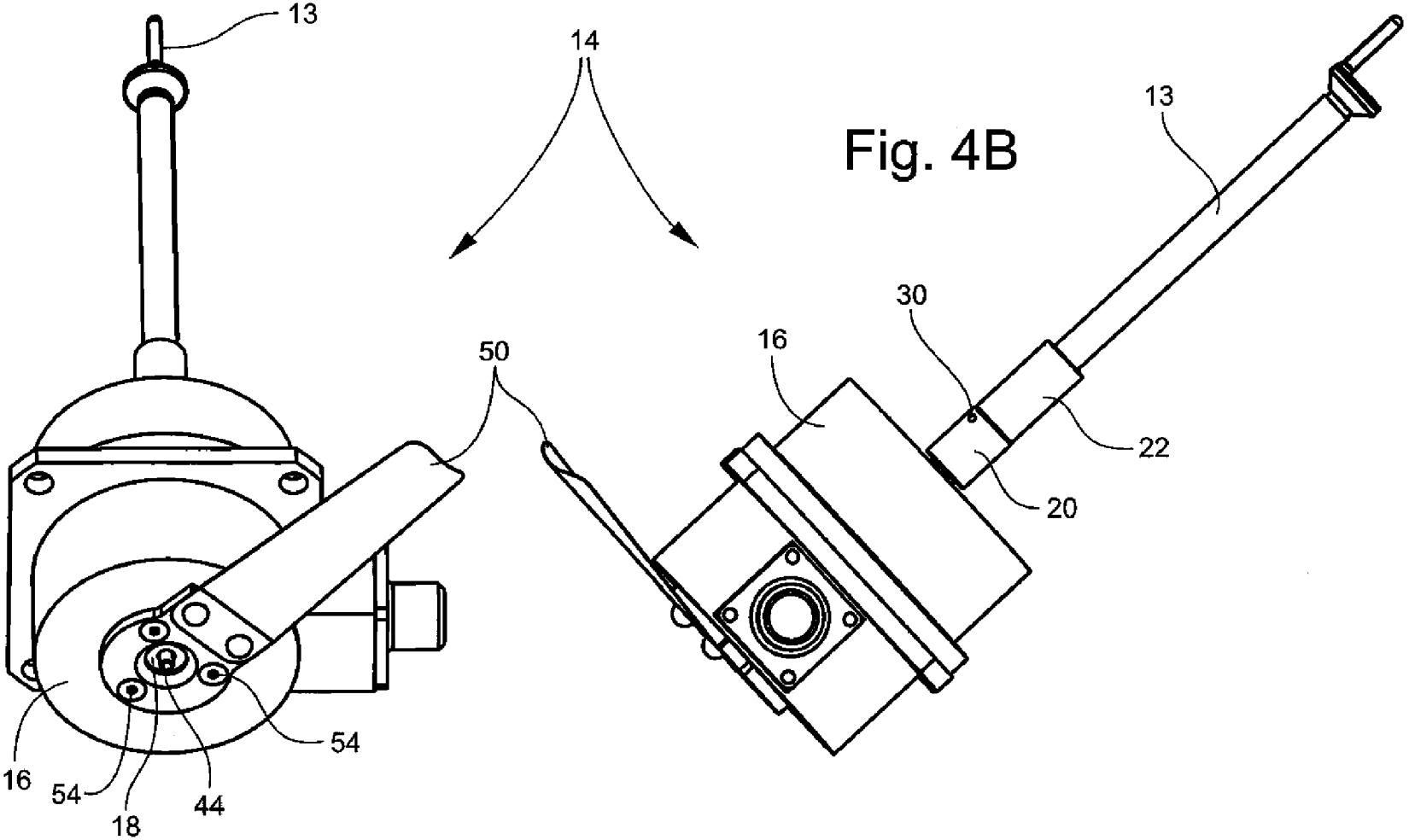
FIG. 4A is a rear perspective view and FIG. 4B is a right side view of the firing pin position indicator of FIG. 2, with the firing pin in the fired position.

FIG. 4A is a rear perspective view and FIG. 4B is a right side view of firing pin position indicator 14 of FIG. 2, with firing pin 13 in the fired position. Solenoid 16 is activated, that is, plunger 18 has been moved inward into the solenoid housing. The breech block is closed and locked. Projecting portion 50, therefore, is in a "forward" position and rotated to the right, as seen in FIG. 4A. In this position, projection portion 50 may not be detected by a sensor 48 (FIG. 2).

Figures 5A, 5B:
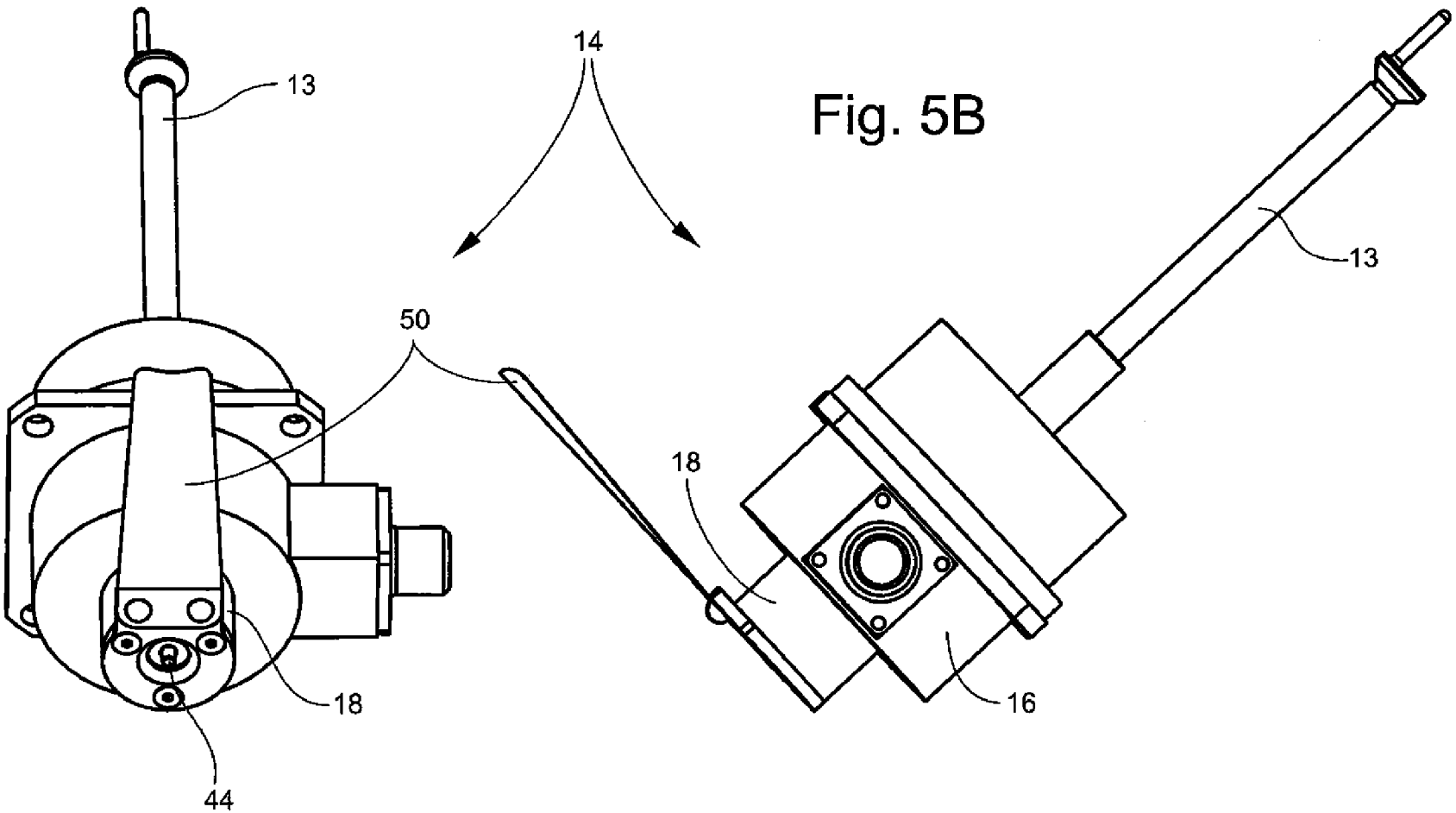
FIG. 5A is a rear perspective view and FIG. 5B is a right side view of the firing pin position indicator of FIG. 2, with the firing pin out of alignment in the non-firing safe position.

FIG. 5A is a rear perspective view and FIG. 5B is a right side view of firing pin position indicator 14 of FIG. 2, with firing pin 13 out of alignment in the non-firing safe position. The breech block is closed but unlocked, that is, the breech block has been rotated counter-clockwise (as viewed in FIG. 5A) from its position in FIG. 4A. Projecting portion 50, therefore, is in a "rear" position and vertical, as seen in FIG. 5A. In this position, projection portion 50 may not be detected by a sensor 48 (FIG. 2).

Figure 6B:
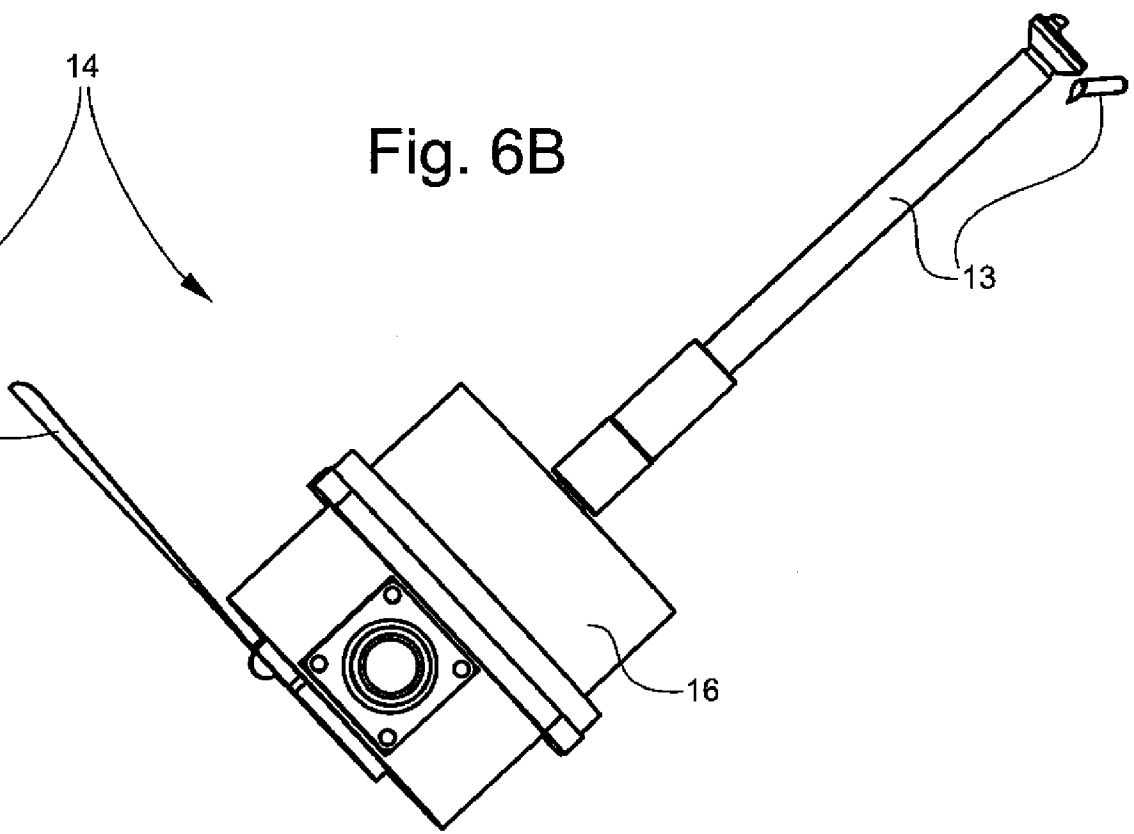
FIG. 6A is a rear perspective view and FIG. 6B is a right side view of the firing pin position indicator of FIG. 2, with the firing pin out of alignment and broken.
Figure 6A:
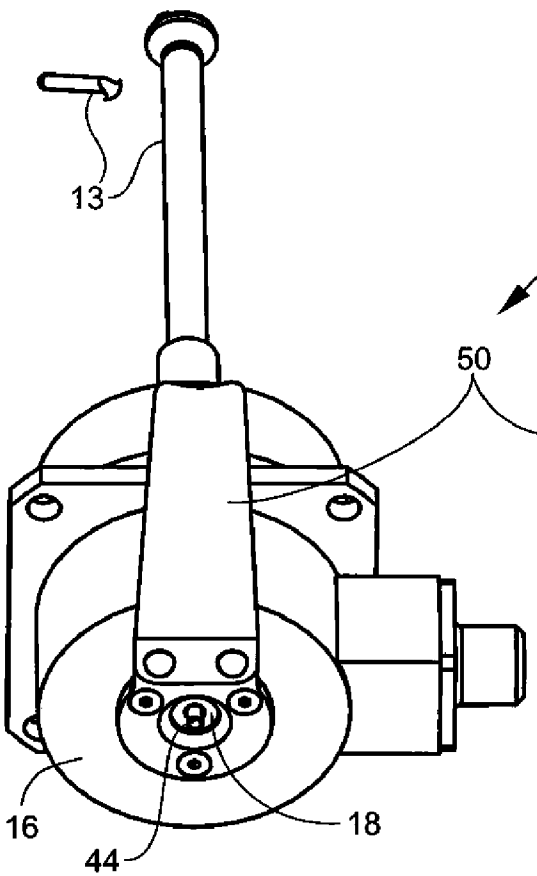

FIG. 6A is a rear perspective view and FIG. 6B is a right side view of firing pin position indicator 14 of FIG. 2, with firing pin 13 out of alignment and broken. The breech block is closed but unlocked. Projecting portion 50, therefore, is in a "forward" position and vertical, as seen in FIG. 6A. In this position, projection portion 50 may not be detected by a sensor 48 (FIG. 2).

If firing pin 13 is stuck forward, plunger 18 will also be stuck forward. With the breech block closed and locked and prior to firing, sensor 48 may not detect projecting portion 50 and the control system may shut down the weapon 10.

To check if firing pin 13 may be broken, solenoid 16 may be activated with the breech block in the closed and unlocked position. When the breech block is closed and unlocked, firing pin 13 is in the safety position (firing pin 13 cannot move forward). But, if the projection portion 50 moves forward and away from sensor 48, then firing pin 13 may be broken.

When the breech block is closed and locked, and projecting portion 50 does not move forward upon activation of solenoid 16, then solenoid 16 may be broken. When the breech block is closed and locked, and projecting portion 50 moves forward, but the round did not detonate and there is no recoil, then the round may be out of range of the travel of firing pin 13 or the round may be bad.

Solenoid 16 may be removed and replaced, for example, by removing mounting screws 52 (FIG. 1) and depressing quick-release actuator pin 44. Projecting portion 50 may be a flexible metal strip made of, for example, spring material. Projecting portion 50 may be removed and replaced, for example, by removing screws 54 (FIGS. 1 and 3A). If projecting portion 50 is flexible, it may be less likely to be bent from recoil or by an operator/maintenance person. Thus, a flexible projecting portion 50 may maintain its proper position with regard to sensor or sensors 48.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A firing pin position indicator mounted to a breech end of a weapon, comprising:

a solenoid including a plunger;

a firing pin adapter that is selectively engageable with the plunger; and a sensor for sensing a position of the plunger; wherein the breech end of the weapon includes a firing in having a longitudinal axis, the firing in rotates about the longitudinal axis from a safe position to a ready-to-fire position, and the firing in position indicator indicates the position of the firing pin.

2. The indicator of claim 1, wherein the firing pin adapter is selectively translatable with the plunger.

3. The indicator of claim 2, wherein the firing pin adapter is selectively rotatable with the plunger.

4. The indicator of claim 1, wherein the plunger is coupled to a quick-release lock and the quick-release lock is selectively engageable with the firing pin adapter.

5. The indicator of claim 4, wherein the quick-release lock includes a spring-loaded piston that is translatable in a quick-release lock housing.

6. The indicator of claim 5, wherein the quick-release lock housing is coupled to the plunger with a pin.

7. The indicator of claim 5, wherein the quick-release lock includes a drive ball and further wherein in a first position of the drive ball the quick-release lock is engaged with the firing pin adapter and in a second position of the drive ball the quick-release lock is not engaged with the firing pin adapter.

8. The indicator of claim 7, wherein the spring-loaded piston includes a notched portion and the firing pin adapter includes an opposing notched portion.

9. The indicator of claim 8, wherein the notched portion of the spring-loaded piston includes a shallow notch and a deep notch and further wherein, in the first position of the drive ball, the drive ball is disposed in the shallow notch of the spring-loaded piston and in the opposing notched portion of the firing pin adapter and, in the second position of the drive ball, the drive ball is disposed in the deep notch of the spring-loaded piston and in the opposing notched portion of the firing pin adapter.

10. The indicator of claim 6, wherein the plunger includes a plunger extension and the quick-release lock housing is coupled to the plunger extension with the pin.

11. The indicator of claim 10, wherein the plunger extension includes a through-bore, the quick-release lock being at least partially disposed in the through-bore, the indicator further comprising a quick-release lock actuator pin at least partially disposed in the through-bore and translatable in the through-bore, the quick-release lock actuator pin being engageable with a head of the spring-loaded piston of the quick-release lock.

12. The indicator of claim 11, wherein translation of the quick-release lock actuator pin causes the quick-release lock to disengage from the firing pin adapter.

13. The indicator of claim 1, wherein the plunger includes a projecting portion and the sensor senses a position of the projecting portion.

14. The indicator of claim 13, wherein the sensor comprises a proximity sensor.

15. The indicator of claim 13, wherein the projecting portion comprises a flexible metal strip.

16. A firing pin position indicator mounted to a breech end of a weapon having a firing pin, comprising:

a solenoid including a plunger;

a firing pin adapter connected to the firing pin of the weapon, the firing pin adaptor being selectively engageable with the plunger; and a sensor for sensing a position of the plunger; wherein the firing in includes a longitudinal axis, the firing in rotates about the longitudinal axis from a safe position to a ready-to-fire position, and the firing in position indicator indicates the position of the firing pin.

17. The indicator of claim 16, wherein the plunger is coupled to a quick-release lock and the quick-release lock is selectively engageable with the firing pin adapter.

18. The indicator of claim 17, wherein the quick-release lock includes a spring-loaded piston that is translatable in a quick-release lock housing.

19. A weapon with a breech end, comprising:

a firing pin position indicator mounted to the breech end, the firing pin position indicator including a solenoid with a plunger and a firing pin adapter that is selectively engageable with the plunger; a sensor for sensing a position of the plunger; and a firing pin having a longitudinal axis connected to the firing pin adapter, wherein the firing in rotates about the longitudinal axis from a safe position to a ready-to-fire position and the firing in position indicator indicates the position of the firing pin.

* * * * *